US006295746B1

(12) United States Patent
Meduna et al.

(10) Patent No.: US 6,295,746 B1
(45) Date of Patent: Oct. 2, 2001

(54) METHOD AND APPARATUS FOR CONTROLLING MOVEMENT OF A WORK IMPLEMENT

(75) Inventors: Gregory L. Meduna, Bismarck, ND (US); Jeffrey L. Slunder, Decatur, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/457,772

(22) Filed: Dec. 9, 1999

Related U.S. Application Data

(60) Provisional application No. 60/112,965, filed on Dec. 18, 1998.

(51) Int. Cl.[7] ..... E02F 3/76; G05D 1/00

(52) U.S. Cl. ..... 37/382; 91/33; 172/4.5

(58) Field of Search ..... 91/32, 33, 450; 37/382; 172/4, 4.5, 810, 812, 813, 819

(56) References Cited

U.S. PATENT DOCUMENTS 4,179,981 * 12/1979 Yeou .
4,934,463 6/1990 Ishida et al. .
5,551,518 * 9/1996 Stratton .
5,647,439 * 7/1997 Burdick et al. .

* cited by examiner

*Primary Examiner*—H. Shackelford
(74) *Attorney, Agent, or Firm*—Wood, Herron & Evans, LLP; J. W. Burrows; Thomas L. Derry

(57) ABSTRACT

A method and apparatus for controlling movement of a work implement movably connected to a work machine. Movement of the work implement is controlled by manual and automatic control valves that are associated with "manual" and "automatic" modes of operation. The manual and automatic control valves are connected between hydraulic motors for controlling movement of the work implement and a hydraulic fluid supply. Each of the manual and automatic control valves governs hydraulic fluid flow to the hydraulic motors. A pressure sensing device is associated with the manual control valves to detect operator modulation of the manual control valves and thereby alter operation of the automatic control valves in the "automatic" mode on the same side of the implement.

12 Claims, 3 Drawing Sheets

METHOD AND APPARATUS FOR CONTROLLING MOVEMENT OF A WORK IMPLEMENT

This application claims the benefit of prior provision patent application Ser. No. 60/112,965 filed Dec. 18, 1998.

TECHNICAL FIELD

The present invention relates generally to manual and automatic positioning of a work implement and, more particularly, to a method and apparatus for controlling manual and automatic movement of a work implement of a work machine.

BACKGROUND ART

Work machines, such as motor graders, dozers, compactors, pavers, profilers and scrapers, are used for geographic surface altering operations. The machines include a work implement, such as a surface altering blade, that is movably connected to a frame of the machine by one or more hydraulic motors or cylinders, or the work implement may be fixed to the machine frame. The position of the blade relative to the work surface must be accurately controlled to achieve the desired surface altering cut.

In motor graders, for example, the surface altering blade is movably connected to the grader frame by a pair of independently actuatable hydraulic lift cylinders that are mounted on either side of the machine frame. The hydraulic lift cylinders are independently extensible and retractable to move corresponding sides of the blade relative to the machine frame. Each side of the blade may be set by the operator to operate in either a "manual" or "automatic" mode of operation.

In the "manual" mode, the operator controls the elevational position of one or both sides of the blade through a pair of control levers mounted in the cab of the grader. Each control lever modulates a corresponding manual control valve connected to that lever. The pair of manual control valves are connected between a hydraulic fluid supply and a corresponding one of the hydraulic lift cylinders. The operator modulates the manual control valves to achieve the desired elevational position of the blade on the manually controlled side of the blade.

A pair of electrically actuatable control valves are also connected between the hydraulic fluid supply and a corresponding one of the hydraulic lift cylinders. The electrically actuatable control valves receive command signals from an implement controller to adjust the elevational position of one or both sides of the blade assigned to the "automatic" mode of operation.

During a grading operation, an operator may desire to adjust the elevational position of one side of the blade by modulating the manual control valve corresponding to each side of the blade. However, if the blade side to be adjusted is assigned to the "automatic" mode of operation, the operator's modulation of the manual control valve may contend with automatic operation of the automatic control valve on that side of the blade when both valves are operated simultaneously. When this occurs, the operator's input to the manual control valve may be resisted, and the desired adjustment in the blade's elevational position may not be achieved. Moreover, simultaneous operation of the manual and automatic control valves on the same side of the blade results in performance and reliability degradation of the motor grader's implement control system.

The present invention is directed to overcoming one or more of the problems as set forth above.

DISCLOSURE OF THE INVENTION

The present invention overcomes the foregoing and other shortcomings and drawbacks of work implement positioning systems and methods heretofore known. While the invention will be described in connection with certain embodiments, it will be understood that the invention is not limited to these embodiments. On the contrary, the invention includes all alternatives, modifications and equivalents as may be included within the spirit and scope of the present invention.

In one aspect of the invention, an apparatus for controlling movement of a work implement of a work machine having a hydraulic pump and a hydraulic motor for actuating the work implement is provided. A work implement positioning device, such as a manually actuatable control lever, is movable by an operator for directing movement of the work implement in a "manual" mode of operation. A manually actuatable control valve is connected to the work implement positioning device, and is further connected between the hydraulic pump and the hydraulic motor. The manual control valve controls operation of the hydraulic motor in the "manual" mode of operation.

An electrically actuatable control valve is connected between the hydraulic pump and the hydraulic motor for controlling operation of the hydraulic motor in an "automatic" mode of operation. An implement controller is coupled to the electrically actuatable control valve for actuating the electrically actuatable control valve in the "automatic" mode.

A pressure sensing device is operatively connected to the manually actuatable control valve, and is further coupled to the implement controller. The pressure sensing device is responsive to hydraulic pressure within the manually actuatable control valve resulting from movement of the work implement positioning device. Upon operator modulation of the work implement positioning device, the pressure sensing device is operable to apply a signal to the implement controller for altering operation of the electrically actuatable control valve in the "automatic" mode. The implement controller may disable the "automatic mode" of the electrically actuatable control valve upon operator modulation of the manual control valve.

Advantageously, the pressure sensing device associated with the manual control valve eliminates contention between the manual control valve and the automatic control valve during control of the work implement, and reduces performance and reliability degradation of the implement control system when the manual and automatic control valves are actuated simultaneously.

In another aspect of the present invention, a method for controlling movement of a work implement of a work machine having a hydraulic pump and a hydraulic motor for actuating the work implement is provided. A manual control valve is connected between the hydraulic pump and the hydraulic motor for controlling operation of the hydraulic motor in a "manual" mode of operation. An electrically actuatable control valve is connected between the hydraulic pump and the hydraulic motor for controlling operation of the hydraulic motor in an "automatic" mode of operation. An implement controller is connected to the electrically actuatable control valve for actuating the electrically actuatable control valve in the automatic "mode". Hydraulic pressure within the manually actuatable valve is monitored, and a signal is applied from the manually actuatable control valve to the implement controller indicating hydraulic pressure within the manually actuatable control valve resulting from movement of the work implement positioning device for altering operation of the electrically actuatable control valve in the "automatic" mode.

BRIEF DESCRIPTION OF THE DRAWINGS

For a better understanding of the present invention, reference may be made to the accompanying drawings in which.

BEST MODE FOR CARRYING OUT THE INVENTION

Figure 1:
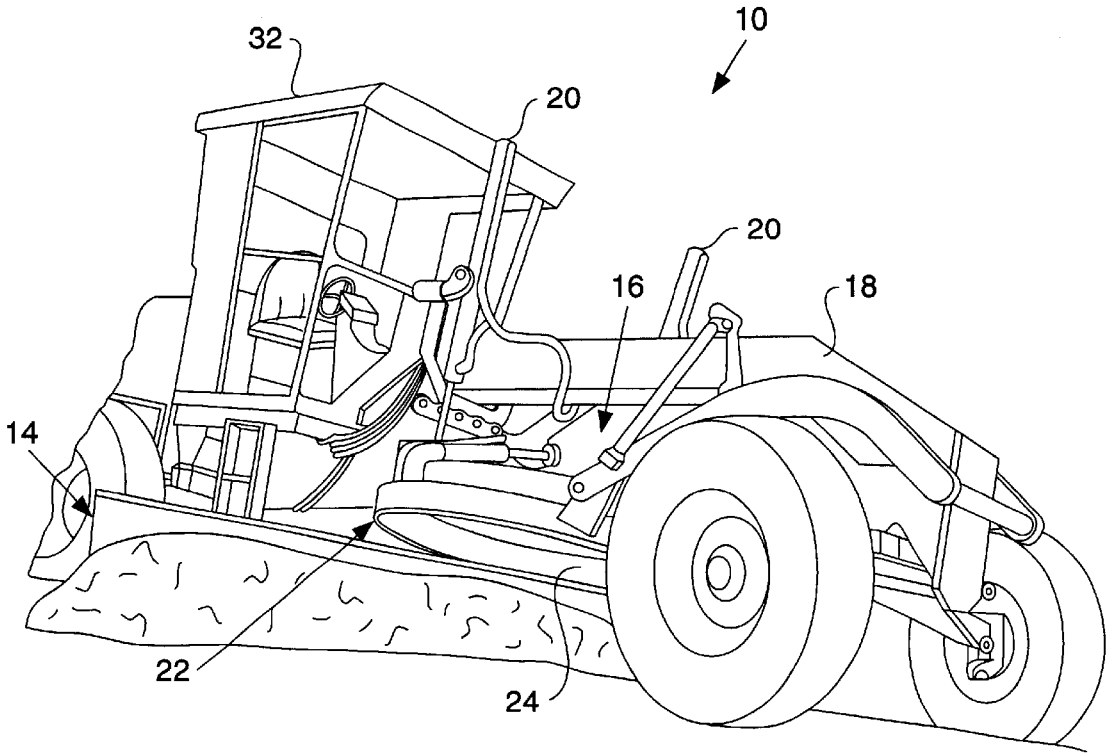
FIG. 1 is a partial perspective view of a motor grader including an implement control system for controlling manual and automatic movement of a work implement.

With reference to the figures, and to FIG. 1 in particular, a work machine, indicated generally at 10, is shown as a motor grader including an implement control system 12 (FIGS. 2–3) for controlling movement of a work implement 14, illustrated as a conventional grader blade. The work implement 14 is part of a blade sub-assembly, indicated generally at 16, that is movably mounted to a frame 18 of the motor grader 10 through a pair of selectively actuatable hydraulic motors or lift cylinders 20 that are connected between the machine frame 18 and the blade sub-assembly 16. The blade sub-assembly 16 includes a circle draw bar, indicated generally at 22, a circle 24 rotatably mounted to the circle draw bar 22, and grader blade 14 mounted to the circle 24. A selectively actuatable circle drive (not shown) is mounted to the circle draw bar 22 for rotating the circle 24 and the blade 14 mounted thereto about an elevational axis located at the center of the circle 24 in a known manner. While the implement control system 12 will be described in detail below as applied to a motor grader, it will be appreciated by those skilled in the art that other geographic surface altering machines, such as dozers, compactors, pavers, profilers, scrapers and the like, equipped with suitable surface altering implements, are equivalents and considered within the scope of the invention.

Figure 2:
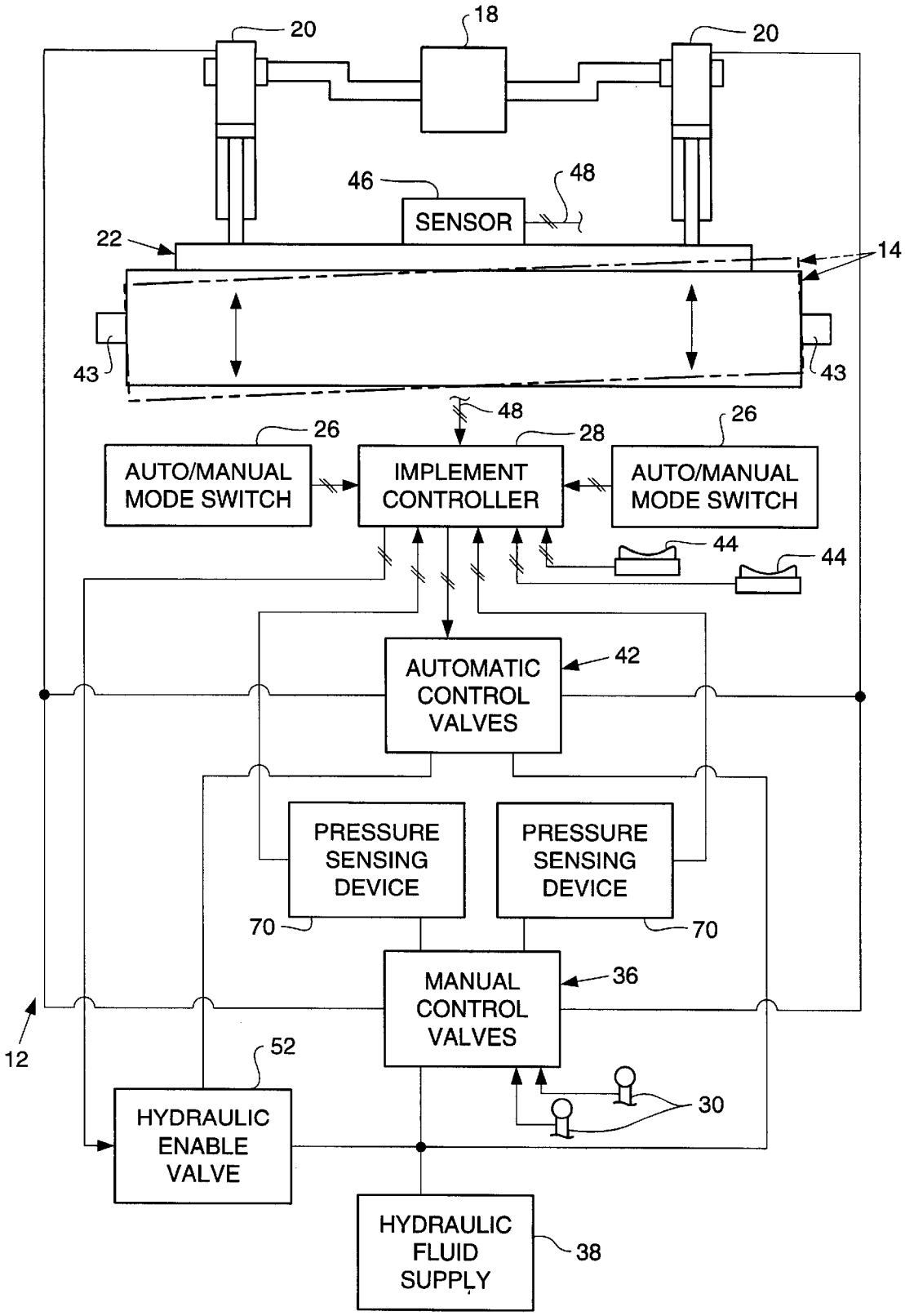
FIG. 2 is a diagram, partly schematic and partly block, showing an implement control system for controlling manual and automatic movement of a work implement as applied to a grader blade of the motor grader shown in FIG. 1.

With reference to FIG. 2, the implement control system 12 is shown applied to motor grader 10 and, in particular, to the grader blade 14. During operation of the motor grader 10, the grade and cross-slope positions of blade 14 may be controlled by manual and/or automatic extension and retraction of the hydraulic lift cylinders 20 connected to the blade sub-assembly 16. The pair of hydraulic lift cylinders 20 are extensibly movable to elevationally move corresponding sides of the blade 14 relative to the machine frame 18.

Each side of the blade 14 may be manually set by the operator to operate in either "manual" or "automatic" modes of operation through a pair of mode select switches 26 that are each dedicated to a corresponding side of blade 14. Control for each side of the blade 14 is independently assignable to one of the "manual" and "automatic" modes of operation such that both sides may be assigned to "manual" mode, one side may be assigned to "manual" mode while the other side is assigned to "automatic" mode, or both sides may be assigned to "automatic" mode. The mode select switches 26 are electrically coupled to an implement controller 28 that is responsible for controlling the side of blade 14 that is assigned to the "automatic" mode of operation as described in greater detail below. Implement controller 28 includes a processor (not shown) of any suitable kind, such as a microprocessor having appropriate control software and memory (not shown) to store the selected "manual" and "automatic" modes of operation for each side of blade 14.

In the "manual" mode, the operator controls the elevational position of one or both sides of the blade 14 through a pair of implement positioning devices, shown as a pair of manually actuatable control levers 30, that are located within a cab 32 (FIG. 1) of the motor grader 10. Each of the manually actuatable control levers 30 is connected to a five-way valve stem 34 (FIG. 3) of a manually actuatable or manual control valve 36. The pair of manual control valves 36 are each connected between a hydraulic fluid supply, i.e., a hydraulic pump 38, and a corresponding one of the hydraulic lift cylinders 20 mounted on a respective side of machine frame 18. Movement of each control lever 30 in one direction allows hydraulic fluid to flow under pressure through the manual control valves 36 to actuate the hydraulic lift cylinders 20 to an extended or retracted position. Movement of each control lever 30 in the opposite direction causes a reverse directional movement of the hydraulic lift cylinders 20. In a neutral position of control levers 30, each valve stem 34 is biased by springs 40 to a neutral or dead position that inhibits hydraulic fluid flow through the manual control valves 36.

Further referring to FIG. 2, a pair of electrically actuatable or automatic control valves 42 are connected between the hydraulic fluid supply or pump 38 and a corresponding one of the hydraulic lift cylinders 20 to control extension and retraction of the corresponding hydraulic lift cylinder 20 in the "automatic" mode. The automatic control valves 42 are electrically coupled to the implement controller 28 for receiving command signals from the implement controller 28 to adjust the elevational position of a corresponding blade side through actuation of a respective hydraulic lift cylinder 20. The automatic control valves 42 are connected in parallel with the manual control valves 36, and are operable independently from the manual control valves 36 as described in detail below.

In the "automatic" control mode, for example, each side of blade 14 may be assigned by the operator to a "grade sensor" mode or a "slope sensor" mode through a pair of sensor select switches (not shown) that are each dedicated to a corresponding side of blade 14. Other sensor modes are possible as well. For example, each side of blade 14 is assignable to a "down force" mode of operation. Control for each side of blade 14 is independently assignable to one of the "grade sensor", "down force" and "slope sensor" modes of operation such that both sides may be assigned to "grade sensor" mode, both sides may be assigned to "down force" mode, or one side may be assigned to "grade sensor" or "down force" mode while the other side is assigned to the "slope sensor" mode. The assigned sensor modes for each side of blade 14 are stored in memory (not shown) of the implement controller 28. For simplicity of discussion, only the "grade sensor" and "slope sensor" modes of operation will be described hereinafter in the automatic operation of motor grader 10. However, it will be appreciated that the "grade sensor", "down force" and "slope sensor" modes of operation may also be assigned to corresponding sides of blade 14 in the "manual" mode as well.

In "grade sensor" mode, an ultrasonic sensor or a laser sensor, both indicated generally at 43 (FIGS. 2–3), may be used to control the elevational position of the respective blade side relative to a grade reference point, such as a finished surface, curb, gutter, stringline or laser reference beam. The ultrasonic sensors or laser sensors 43 are coupled to the implement controller 28, and provide signals to the implement controller 28 indicating the elevational position of the corresponding side of blade 14.

In "grade sensor" mode, the grade sensor controlled side of blade 14 is maintained generally at a preselected elevational position or grade by the implement controller 28 that continuously compares the actual elevational position as determined by the grade sensor 43 with a desired grade setting selected by the operator. The implement controller 28 makes compensating elevational adjustments of the grade controlled side of the blade 14 through actuation of the corresponding hydraulic lift cylinder 20 as required. The operator selected "grade sensor" mode elevational value (or pair of values if both blade sides are assigned to the "grade sensor" mode) is assigned to the implement controller 28 through a corresponding one (or both) of a pair of momentary rocker switches 44 (FIG. 2) that are electrically coupled to the implement controller 28.

A two-axis blade slope sensor, indicated generally at 46 (FIGS. 2 and 3) is mounted on the blade sub-assembly 16 to provide blade pitch and blade roll signals to the implement controller 28 through electrical leads 48. In the "automatic" mode, each side of the blade 14 may alternatively be assigned to a "slope sensor" mode in which the grade sensor controlled side of the blade 14 is maintained at the preselected elevational position as described above, while the implement controller 28 controls the cross slope of the "slope sensor" controlled blade side according to a kinematic control algorithm performed by the implement controller 28. As used herein, "cross slope" is the slope of a cut made by the blade 14 perpendicular to the direction of machine travel. The implement controller 28 receives the blade pitch and blade roll signals from the two-axis blade slope sensor 46, as well as signals from other sensors (not shown) indicating blade rotation, machine frame pitch and machine frame roll. Each of these values is taken into account by the kinematic control algorithm to accurately control the cross slope of the slope controlled side of the blade 14.

In "slope sensor" mode, the slope sensor controlled side of the blade 14 is maintained generally at a preselected elevational position as defined by the elevational position of the grade controlled side of blade 14 and the operator selected cross slope value. The implement controller 28 continuously compares the actual cross slope value computed from the various sensor signals with the desired cross slope, and makes compensating elevational adjustments through actuation of the corresponding hydraulic lift cylinder 20 as required. The operator selected "slope sensor" mode elevational value, i.e, cross slope value, is assigned to the implement controller 28 through a touch pad set point capture button. The cross slope value can be modified by a corresponding one of the pair of momentary rocker switches 44 electrically coupled to the implement controller 28.

Figure 3:
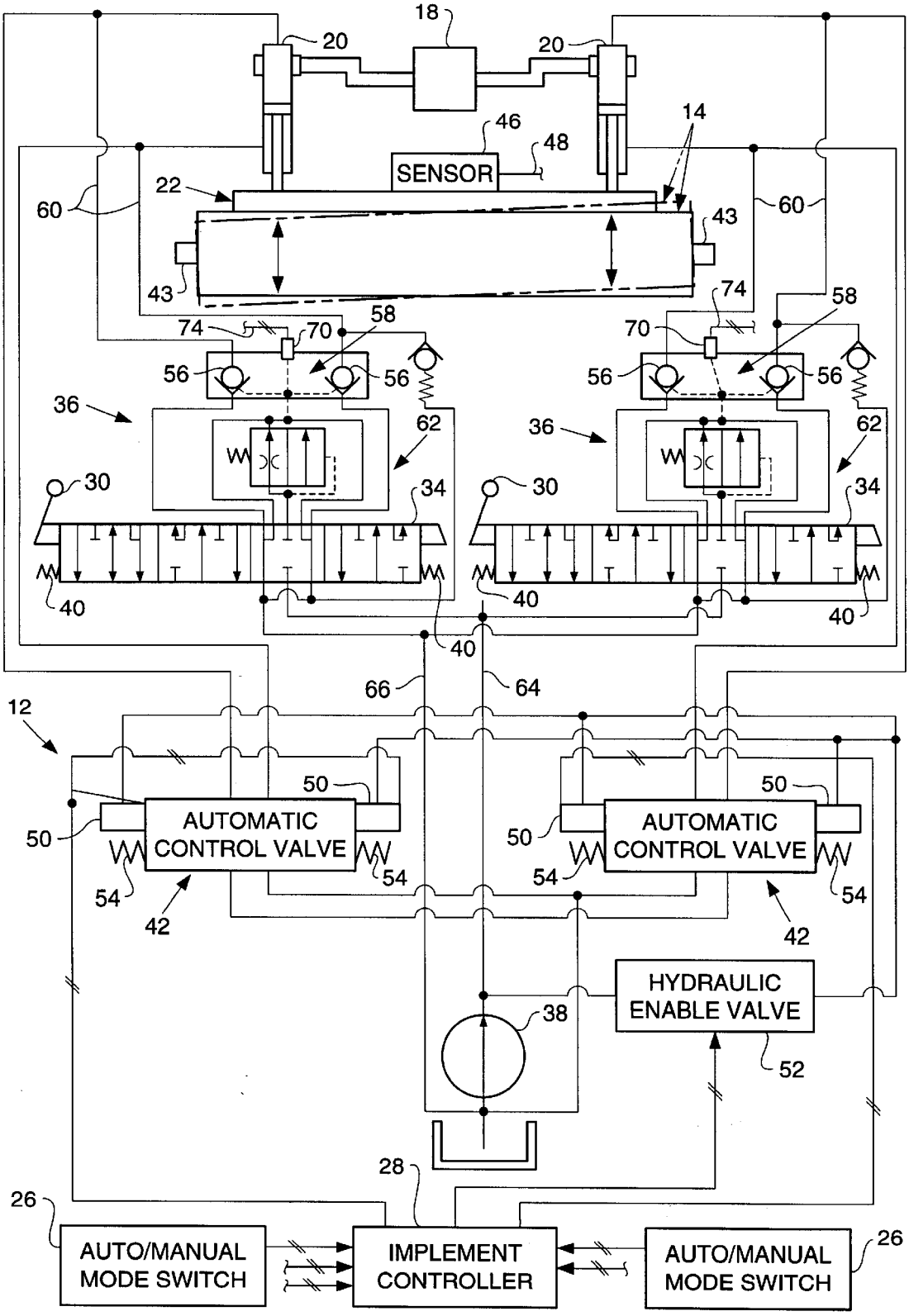
FIG. 3 is a circuit diagram of the implement control system shown in FIG. 2.

As best understood with reference to FIG. 3, each electrically actuatable or automatic control valve 42 includes a pair of HYDRAC valves 50 at opposite ends of each valve 42 that are electrically coupled to the implement controller 28. An exemplary HYDRAC valve is disclosed in U.S. Pat. No. 5,366,202 issued on Nov. 22, 1994 to Stephen V. Lunzman. A solenoid-operated hydraulic enable valve 52 is also electrically coupled to implement controller 28 for directing pilot fluid flow from the hydraulic fluid supply 38 to the HYDRACS 50. When one or both sides of the blade 14 are assigned to the "automatic" mode, the implement controller 28 applies a signal to open the normally-closed hydraulic enable valve 52 and direct pilot fluid flow to the HYDRACS 50. The HYDRACS 50 are inactive in the absence of a command signal from the implement controller 28, and therefore allow the valve stem (not shown) of the automatic control valves 42 to assume a neutral or closed position as defined by the force of springs 54.

Figure 4:
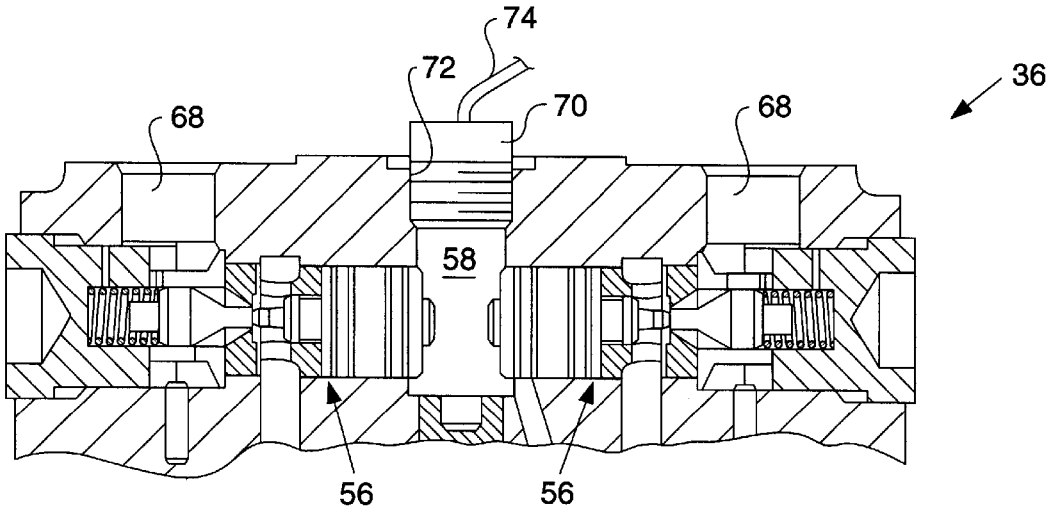
FIG. 4 is a partial cross-sectional view of a manually actuatable control valve in the implement control system for manually controlling movement of a work implement.

As best understood with reference to FIGS. 3 and 4, each manual control valve 36 has a pair of normally-closed lock valves 56 each operatively connected between a chamber portion 58 of the manual control valve 36 and one of a pair of hydraulic fluid conduits 60 connected to each hydraulic lift cylinder 20. Each manual control valve 36 also includes an infinitely variable compensator flow valve 62 that directs hydraulic fluid from supply line 64 into the chamber portion 58 of the manual control valve 36 upon operator modulation of the control lever 30. The hydraulic pressure created in the chamber portion 58 forces the pair of normally-closed lock valves 56 to open. In their open state, the lock valves 56 permit hydraulic fluid to flow through manual control valve 36 from supply line 64 to a selected one of the conduits 60 connected to one end of the hydraulic lift cylinder 20. At the same time, hydraulic fluid is permitted to flow through the manual control valve 36 from the other end of hydraulic lift cylinder 20 and the other conduit 60 to a return line 66. Each of the conduits 60 are connected at one end to receiving bores 68 formed in the manual control valves 36.

To avoid contention between operation of the manual control valves 36 and the automatic control valves 42 on the same side of blade 14, a pressure sensing device 70, such as a pressure transducer, mechanical pressure switch or equivalent pressure sensing device, is associated with each manual control valve 36 to detect operator modulation of the control levers 30. Upon operator modulation of the control levers 30, a signal is applied from the pressure sensing device 70 to the implement controller 28 for altering operation of the automatic control valves 42 in the "automatic" mode when manual and automatic control valves 36 and 42 are operated simultaneously on the same side of blade 14. The pressure sensing devices 70 are operatively connected to the respective chamber portions 58 of the manual control valves 36 for sensing hydraulic pressure within the chamber portions 58. As best seen in FIG. 4, the pressure sensing devices 70 are threadably coupled or otherwise fastened in a receiving bore 72 that extends into the chamber portion 58 of the manual control valves 36. Each pressure sensing device 70 is coupled to the implement controller 28 through electrical leads 74 for providing one or multiple signals to the implement controller 28 indicating hydraulic pressure within the chamber portion 58 resulting from modulation of the control levers 30. For example, a pressure transducer may continuously apply pressure indicating signals to the implement controller 28, while a mechanical pressure switch will provide only one signal to the implement controller 28 upon actuation of the pressure switch at a predetermined hydraulic pressure within the chamber portion 58.

The implement controller 28 is operable to receive the pressure indicating signal from the pressure sensing devices 70 and alter the operation of the automatic control valves 42 in a predetermined manner. For example, if one side of the blade 14 is assigned to "manual" mode and the other side is assigned to "automatic" mode, the implement controller 28 may ignore pressure indicating signals generated by the pressure sensing device 70 on the manually controlled side of blade 14 to permit a single lever lift of the manually controlled side of blade 14.

If one or both sides of the blade 14 are assigned to "automatic" mode, then modulation of the manual control valve 36 on the automatically controlled side of the blade 14 is acted upon by the implement controller 28 to reduce contention between operation of the manual and automatic control valves 36 and 42 on the same side of the blade 14. When the implement controller 28 receives a pressure signal from a pressure sensing device 70 indicating operator modulation of the manual control valve 36 on the automatic control side of blade 14, the implement controller 28 may remove electrical signals applied to the pair of HYDRACS 50 of the corresponding automatic control valve 42 to cause the automatic control valve stem (not shown) to move to a neutral or dead position. The implement controller 28 may also reset the assigned "automatic" control mode back to "manual" control mode to remove electrical signals applied from implement controller 28 to the hydraulic enable valve 52. Upon reset to the "manual" mode, the hydraulic enable valve 52 resumes its normally-closed position to close the valve 52 and prevent pilot fluid flow to the corresponding pair of HYDRACS 50 of the automatic control valve 42.

Alternatively, the implement controller 28 may acknowledge a pressure indicating signal from a pressure sensing device 70 indicating operator modulation of the manual control valve 36 on the "automatic" control side of blade 14. The implement controller 28 may remove electrical signals applied to the HYDRACS 50 of the corresponding automatic control valve 42 to cause the automatic control valve stem (not shown) to move to a neutral or dead position. However, the implement controller may not reset the assigned "automatic" control mode to the "manual" mode, but rather impose an "auto hold" state for the automatic control valve 42.

In the "auto hold" state, the implement controller 28 monitors the change in position of the blade 14 resulting from operator modulation of the manual control valve 36. If the change in blade position does not exceed a programmed value stored in the implement controller 28, such as ten (10) percent, the "automatic" mode is maintained and the blade 14 is automatically moved back to its "automatic" mode programmed position. This aspect in the operation of the implement control system 12 accommodates for accidental operator movement of the control levers 30. If, however, the manual change in the blade position exceeds the programmed value, the pressure signal generated by the pressure sensing device 70 of the manual control valve 36 is acknowledged, and the assigned "automatic" control mode is reset to the "manual" mode as described above. The implement controller 28 may also reset the assigned "automatic" mode to the "manual" mode when a fault condition occurs in the implement control system 12 to prevent accidental movement of blade 14 and damage to the valve components of the motor grade 10.

Industrial Applicability

With reference to the drawings and in operation, the operator of the work machine 10 selects "manual" or "automatic" modes of operation for each side of the blade 14 by actuating the mode select switches 26 corresponding to each side of the blade 14. In either mode, the operator also selects "grade sensor", "down force" or "slope sensor" control for each side of the blade 14 by actuating sensor select switches (not shown) corresponding to each side of the blade 14. Control of each side of blade 14 is independently assignable to one of the "manual" and "automatic" modes of operation, and one of the "grade sensor", "down force" and "slope sensor" modes as well.

In the "manual" mode, the operator controls the grade or elevational position of the manually controlled side of the blade 14 through modulation of the corresponding control lever 30. Movement of control lever 30 actuates the manual control valve 36 on the manually controlled side of the blade 14 to adjust the elevational position of the implement on that side. The operator may set the other side of blade 14 to operate in the "automatic" mode through the automatic control valve 42, and control that side of the blade 14 in either the "grade sensor", "down force" or "slope sensor" mode.

In the event the operator modulates the manual control valve 36 on the automatic controlled side of blade 14 through movement of control lever 30, the pressure sensing device 70 associated with the manual control valve 30 detects the operator modulation of the manual control valve 36 and applies a signal to the implement controller 28 for altering operation of the automatic control valve 42 in the "automatic" mode on that side of blade 14.

The pressure sensing device 70 in each of the pair of manual control valves 36 eliminates contention between the manual control valves 36 and the automatic control valves 42 on the same side of the blade 14 and reduces performance and reliability degradation of the implement control system 12 when the manual and automatic control valves 36 and 42 are actuated simultaneously on the same side of blade 14.

Other aspects, objects and advantages of the present invention can be obtained from a study of the drawings, the disclosure and the appended claims.

What is claimed is:

1. An apparatus for controlling movement of a work implement of a work machine having a hydraulic pump and a hydraulic motor for actuating the work implement, comprising:

a work implement positioning device movable by an operator for directing movement of the work implement in a manual mode;

a manually actuatable control valve connected to the work implement positioning device and further being connected between the hydraulic pump and the hydraulic motor for controlling operation of the hydraulic motor in the manual mode;

an electrically actuatable control valve connected between the hydraulic pump and the hydraulic motor for controlling operation of the hydraulic motor in an automatic mode;

a position sensor connected to the work implement and being operable to generate a signal that is representative of the position of the work implement;

an implement controller coupled to the electrically actuatable control valve and the position sensor for actuating the electrically actuatable control valve in the automatic mode, the implement controller being operable to maintain the automatic mode of the electrically actuatable control valve upon receipt of a signal from the position sensor that is indicative of movement of the work implement within a predetermined value; and a pressure sensing device operatively connected to the manually actuatable control valve and further being coupled to the implement controller, wherein the pressure sensing device is responsive to hydraulic pressure within the manually actuatable control valve resulting from movement of the work implement positioning device and operable to apply a signal to the implement controller for altering operation of the electrically actuatable control valve in the automatic mode.

2. An apparatus as recited in claim 1, wherein the pressure sensing device is operable to apply an electrical signal to the implement controller indicating hydraulic pressure within the manually actuatable control valve.

3. An apparatus as recited in claim 1, wherein the implement controller is operable to disable the automatic mode of the electrically actuatable control valve upon movement of the work implement beyond the predetermined value.

4. An apparatus as recited in claim 1, wherein the electrically actuatable control valve is connected in parallel with the manually actuatable control valve for independent operation therewith.

5. An apparatus as recited in claim 1, wherein the work implement is a blade of a motor grader.

6. An apparatus for controlling movement of a blade of a motor grader having a hydraulic pump and a pair of hydraulic lift cylinders for actuating the blade to a preselected slope of cut relative to a geographic surface, comprising:

a pair of blade positioning devices movable by an operator for directing movement of the blade in a manual mode, each of the blade positioning devices controlling movement of a respective side of the blade;

a pair of manually actuatable control valves each connected to one of the blade positioning devices and each further being connected between the hydraulic pump and one of the hydraulic lift cylinders for controlling operation of the hydraulic lift cylinders in the manual mode;

a pair of electrically actuatable control valves each connected between the hydraulic pump and one of the hydraulic lift cylinders for controlling operation of the hydraulic cylinders in an automatic mode;

a position sensor connected to the work implement and being operable to generate a signal that is representative of the position of the work implement;

a controller coupled to the electrically actuatable control valves and the position sensor for actuating the electrically actuatable control valves in the automatic mode, the controller being operative to maintain the automatic mode of the electrically actuatable control valves in response to receipt of the signal from the position sensor indicative of the blade being moved within a predetermined value; and a pair of pressure sensing devices each operatively connected to one of the manually actuatable control valves and each further being coupled to the controller, wherein each of the pressure sensing devices is responsive to hydraulic pressure within the manually actuatable control valve resulting from movement of the blade positioning device and operable to apply a signal to the controller for altering operation of the electrically actuatable control valves in the automatic mode.

7. An apparatus as recited in claim 6, wherein the controller is operable to move the electrically actuatable control valves to a closed position upon movement of the blade beyond the predetermined value.

8. A method for controlling movement of a work implement of a work machine having a hydraulic pump and a hydraulic motor for actuating the work implement, comprising:

connecting a manually actuatable control valve between the hydraulic pump and the hydraulic motor for controlling operation of the hydraulic motor in a manual mode;

connecting an electrically actuatable control valve between the hydraulic pump and the hydraulic motor for controlling operation of the hydraulic motor in an automatic mode;

generating a signal indicative of the position of the work implement;

coupling an implement controller to the electrically actuatable control valve and the position sensor for actuating the electrically actuatable control valve in the automatic mode, the implement controller being operative to maintain the automatic mode of the electrically actuatable control valve in response to receipt of a signal from the position sensor that is indicative of movement of the work implement within a predetermined value;

monitoring hydraulic pressure within the manually actuatable control valve; and applying signals from the manually actuatable control valve and the position sensor to the implement controller indicating hydraulic pressure within the manually actuatable control valve resulting from movement of the work implement positioning device and degree of movement of the work implement for altering operation of the electrically actuatable control valve in the automatic mode.

9. A method as recited in claim 8, including the step of disabling the automatic mode of the electrically actuatable control valve upon movement of the work implement beyond the predetermined value.

10. The method as recited in claim 9, including the step of connecting the electrically actuatable control valve in parallel with the manually actuatable control valve for independent operation therewith.

11. A geographic surface altering work machine, comprising:

a moveable frame;

a work implement moveably connected to the frame;

a hydraulic pump;

a hydraulic motor connected to hydraulic pump for actuating the work implement; and an apparatus for controlling movement of the work implement according to claim 1.

12. An apparatus for controlling movement of a work implement of a work machine having a hydraulic pump and a hydraulic motor for actuating the work implement, comprising:

a work implement positioning device movable by an operator for directing movement of the work implement in a manual mode;

a manually actuatable control valve connected to the work implement positioning device and further being connected between the hydraulic pump and the hydraulic motor for controlling operation of the hydraulic motor in the manual mode, the manually actuatable control valve includes a chamber portion and a valve structure having a pair of lock valves operatively connected to the chamber portion and being operable to control hydraulic fluid flow through the manually actuatable control valve in response to hydraulic pressure within the chamber portion;

an electrically actuatable control valve connected between the hydraulic pump and the hydraulic motor for controlling operation of the hydraulic motor in an automatic mode;

an implement controller coupled to the electrically actuatable control valve for actuating the electrically actuatable control valve in the automatic mode; and a pressure sensing device operatively connected to the chamber portion of the manually actuatable control valve and further being coupled to the implement controller, wherein the pressure sensing device is responsive to hydraulic pressure within the chamber portion of the manually actuatable control valve resulting from movement of the work implement positioning device and operable to apply a signal to the implement controller for altering operation of the electrically actuatable control valve in the automatic mode.

* * * * *